US006034310A

United States Patent [19]

Kolano

[11] Patent Number: 6,034,310

[45] Date of Patent: Mar. 7, 2000

[54] STRING INSTRUMENT, METHOD OF PLAYING A STRING INSTRUMENT, APPARATUS FOR MANUFACTURE OF A STRING INSTRUMENT, AND STRING INSTRUMENT KIT

[76] Inventor: Jozef Kolano, 4849 W. Barry, Chicago, Ill. 60641

[21] Appl. No.: 08/856,279

[22] Filed: May 14, 1997

[51] Int. Cl.[7] ..... G10D 3/00

[52] U.S. Cl. ..... 84/293; 84/314 R

[58] Field of Search ..... 84/293, 314 R

[56] References Cited

U.S. PATENT DOCUMENTS

| | | | |
|---|---|---|---|
| 652,353 | 6/1900 | Edgren | 84/267 |
| 1,931,418 | 10/1933 | Stëssel | 84/314 R |
| 2,989,884 | 6/1961 | Bunker | 84/267 |
| 3,635,116 | 1/1972 | Pelensky | 84/291 |
| 3,688,632 | 9/1972 | Perez | 84/314 R |
| 4,023,460 | 5/1977 | Kuhnke | 84/314 R |
| 4,167,133 | 9/1979 | Adams, Jr. | 84/293 |
| 4,508,003 | 4/1985 | Smakula | 84/293 |
| 4,852,450 | 8/1989 | Novak | 84/314 R |
| 5,133,239 | 7/1992 | Thomas | 84/314 R |

*Primary Examiner*—Robert E. Nappi
*Assistant Examiner*—Shih-yung Hsieh
*Attorney, Agent, or Firm*—Michael Best & Friedrich

[57] ABSTRACT

The present invention includes a string instrument that includes a neck having a finger board, a finger board having a plurality of frets and having a finger board axis along the length of the finger board, the frets having substantially parallel fret axes, and the fret axes oriented at a non-perpendicular angle with respect to the finger board axis. The non-perpendicular angle is an obtuse angle or an acute angle. The string instruments are fretted string instruments including a guitar, a harp, a zither, an electric guitar, a bass guitar, mandolin, sitar, ukulele, and banjo. It is another object of the invention to provide a method of manufacturing a string instrument that includes the steps of attaching the plurality of the substantially parallel frets on the finger board of the instrument along the length of the finger board at a non-perpendicular angle with respect to the finger board axis; and, forming and assembling the string instrument. The invention also provides a kit for playing music. The kit includes a string instrument and a number of string instrument accessories. These kit includes a instrument including a finger board having a plurality of frets and having a finger board axis along the length of the finger board, the frets having substantially parallel fret axes, and the fret axes oriented at a non-perpendicular angle with respect to the finger board axis; and, a string instrument accessory. Exemplary string instrument accessories include a strap, tuning knobs, strings, a string instrument carrying case, a synthesizer, a mixer, an amplifier, speakers, guitar cable, foot pedals, a computer having a microprocessor, and a loudspeaker.

16 Claims, 6 Drawing Sheets

STRING INSTRUMENT, METHOD OF PLAYING A STRING INSTRUMENT, APPARATUS FOR MANUFACTURE OF A STRING INSTRUMENT, AND STRING INSTRUMENT KIT

BACKGROUND OF THE INVENTION

This invention generally relates to string instruments, a method of playing a stringed instrument, an apparatus for manufacture of a string instrment, and a string instrument kit.

FIG. 1 illustrates a guitar of the prior art. Guitar 1 of the prior art includes a number of frets 4 that are oriented at 90 degrees (angle $\alpha$) with respect to an imaginary line 2 running down the center of neck 5. Known string instruments have the drawback that beginners, users and experts including rock stars and other entertainers experience finger and hand fatigue from extended play. This fatigue results from the arrangement of the frets 4 on the finger board of the instrument. For at least the last 400 years these frets have been arranged at a perpendicular angle with respect to an imaginary line running down the center of the neck of the string instrument.

Rock stars or other entertainers who value speed in their play such as heavy metal performers find playing these string instruments rapidly to be difficult since the perpendicular arrangement of the frets on the neck of the instrument is not conducive to rapid play. A further drawback of known string instruments is that the arrangement of the frets at a perpendicular angle provides for an inadequate reach to all of the chords that are desired. Hence, there exists a need for a string instrument that will provide a user with a longer reach with a user's fingers, provide access to a greater number of chords with a user's individual fingers, and provide a greater span of frets that a user's fingers can reach. There also exists a need for a string instrument that will greatly facilitate the playing of chords for both a novice and expert user. There further exists a need for a string instrument that will decrease muscle and joint fatigue during extended play of the instrument, for an instrument that releases the tension on the joints in the thumb and associated with the thumb and hand, and help alleviate carpal tunnel syndrome and nerve injury.

Another problem with known string instruments results in the wear on the decorative surfaces including the neck of the instrument during extended play. A user's hand, palm, and/or fingers pass along the neck of an instrument repeatedly and the friction between the user's hand and finger's rubs off the paint or other decorative surface that is generally placed on the neck. A further problem includes joint, nerve and muscle pressure and damage from extended play. Much of this wear and damage can be attributed to the generally faulty design of the necks of string instments. Hence, there exists a need for a string instrument that provides a neck of a design and construction that will reduce the amount of paint or other decorative material that is rubbed off the neck due to repeated play, and for a string instrument that will reduce the risk of muscle, joint and nerve damage from extended play.

Yet another shortcoming of known string instruments includes the warping of the neck due to the tension the neck is under from the strings once they are tightened. Attempts at curing this shortcoming have included the inclusion of bolts in the body of the neck which are tightened to bring the neck back into alignment. These attempted solutions have the further drawback of requiring manual adjustment by a user over time or costly manufacture. Hence, there exists a need for string instrument having a neck that does not require repeated manual adjustment, that will not warp over time and that will be inexpensive to manufacture.

There exists a need to solve the problems in the art that are articulated above. It is an object of the invention to solve these problems.

SUMMARY OF THE INVENTION

Accordingly, it is an object of the invention to overcome the shortcomings of the prior art by providing a string instrument that includes a finger board having a plurality of frets and having a finger board axis along the length of the finger board, the frets having substantially parallel fret axes, and the fret axes oriented at a non-perpendicular angle with respect to the finger board axis.

The non-perpendicular angle is an obtuse angle or an acute angle. The angles can also be in the range of 89 degrees to about 85 degrees, in the range of about 85 degrees to about 75 degrees, in the range of about 75 degrees to about 65 degrees, in the range of about 65 degrees to about 45 degrees, in the range of about 45 degrees to about 1 degree, in the range of about 91 degrees to about 95 degrees, in the range of about 95 degrees to about 105 degrees, or in the range of about 105 degrees to about 179 degrees.

Exemplary string instruments that utilize the inventions described herein include a guitar, a harp, a zither, an electric guitar, a bass guitar, mandolin, sitar, ukulele, and banjo.

It is another object of the invention to provide a method of manufacturing a string instrument that includes the steps of attaching the plurality of the substantially parallel frets on the finger board of the instrument along the length of the finger board at a non-perpendicular angle with respect to the finger board axis; and, forming and assembling the string instrument.

The method can be executed manually or with an apparatus for manufacturing a string instrument that includes a fret connector for attaching the plurality of the substantially parallel frets on the finger board along the length of the finger board at a non-perpendicular angle with respect to the finger board axis; and, a string instrument former and assembler.

The invention also provides a kit for playing music. The kit includes a string instrument as described herein and a number of string instrument accessories. The kit includes an instrument including a finger board having a plurality of frets and having a finger board axis along the length of the finger board, the frets having substantially parallel fret axes, and the fret axes oriented at a non-perpendicular angle with respect to the finger board axis; and, a string instrument accessory. Exemplary string instrument accessories include a strap, tuning knobs, strings, a string instrument carrying case, a synthesizer, a mixer, an amplifier, speakers, guitar cable, foot pedals, a computer having a microprocessor, and a loudspeaker.

It is yet a further object of the invention to provide a neck for a string instrument. The neck includes a finger board having a plurality of frets and having a finger board axis along the length of the finger board, the frets having substantially parallel fret axes, and the fret axes oriented at a non-perpendicular angle with respect to the finger board axis.

It is another object of the invention to provide a neck for a string instrument that is contoured along the length of the neck body to accommodate a user's thumb joint, muscles, or bone of a user on a hand of a user that grasps the neck body of the string instrument so that wear on the neck body during repeated play by a user is reduced.

The invention also includes a neck for a string instrument which includes a finger board having a plurality of frets, a neck body connected to the finger board, the neck body having a reinforcing member curved downwardly toward the bottom of the neck body so that warping of said neck is greatly reduced. The necks of the present invention are provided alone or connected to a string instrument. The reinforcing member extends across a full width of the neck body in one variant, or the reinforcing member extends partially across the width of the neck body in another variant.

It is yet another object of the invention to solve the problem that beginners, users and experts experience with finger and hand fatigue from extended play. Yet another object of the invention is to provide a string instrument that allows rock stars or other entertainers who value speed in their play such as heavy metal performers to play these string instruments more rapidly.

Yet another object of the invention is to provide a string instrument that provides an arrangement of the frets at a non-perpendicular angle to give an adequate reach to all of the chords that are desired, to provide a string instrument that will give a user a longer reach with a user's fingers, to provide access to a greater number of chords with a user's individual fingers, and to provide a greater span of frets that a user's fingers can reach.

Another object of the invention is to provide a string instrument that will greatly facilitate the playing of chords for both a novice and expert user, to provide a string instrument that will decrease muscle and joint fatigue during extended play of the instrument, to provide for an instrument that releases the tension on the joints in the thumb and associated with the thumb and hand, and help alleviate carpal tunnel syndrome and nerve injury, and to provide a string instrument that makes learning how to play the string instrument easier.

Yet a further object of the invention is to provide a string instrument that minimizes wear on the decorative surfaces including the neck of the instrument during extended play when a user's hand passes along the neck of an instrument repeatedly over the neck, provides a decreased prevalence of joint, nerve and muscle pressure and damage from extended play, and that provides a neck of a design and construction that will reduce the amount of paint or other decorative material that is rubbed off the neck.

The present invention also overcomes the problem of warping of the neck of a string instrument due to the tension the neck is under from the strings once they are tightened.

The objects and features of the present invention, other than those specifically set forth above, will become apparent in the detailed description of the invention set forth below and in the drawings.

DETAILED DESCRIPTION OF THE INVENTION

Figure 1:
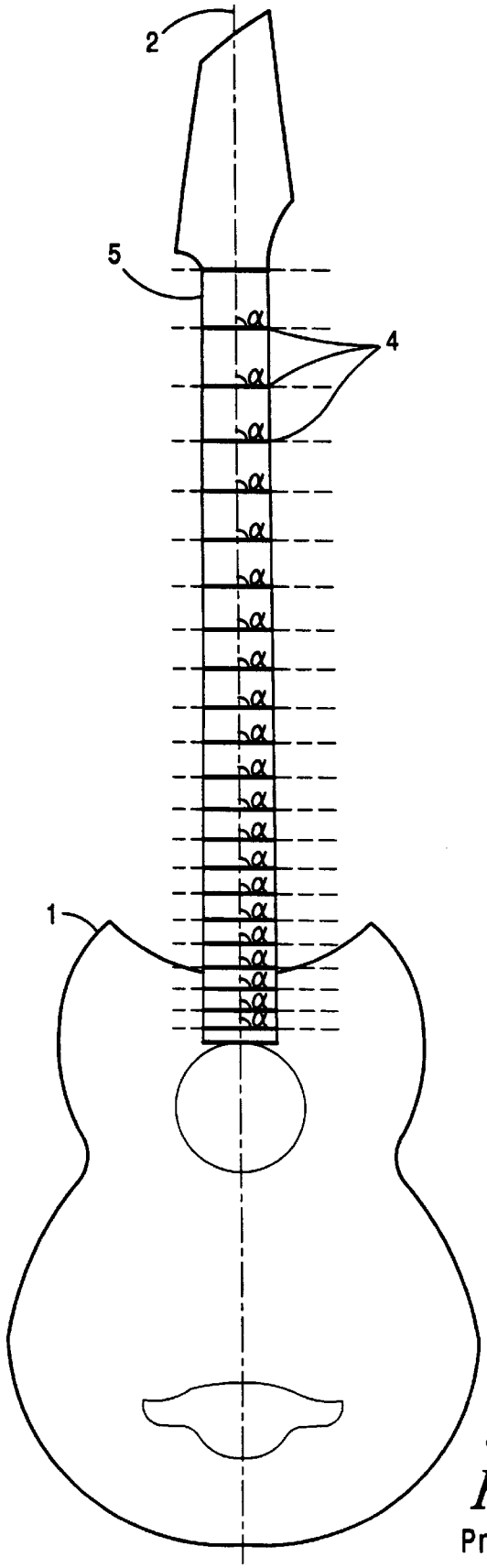
FIG. 1 Prior Art
FIG. 1 is a top plan view of a prior art guitar.
Figure 2:
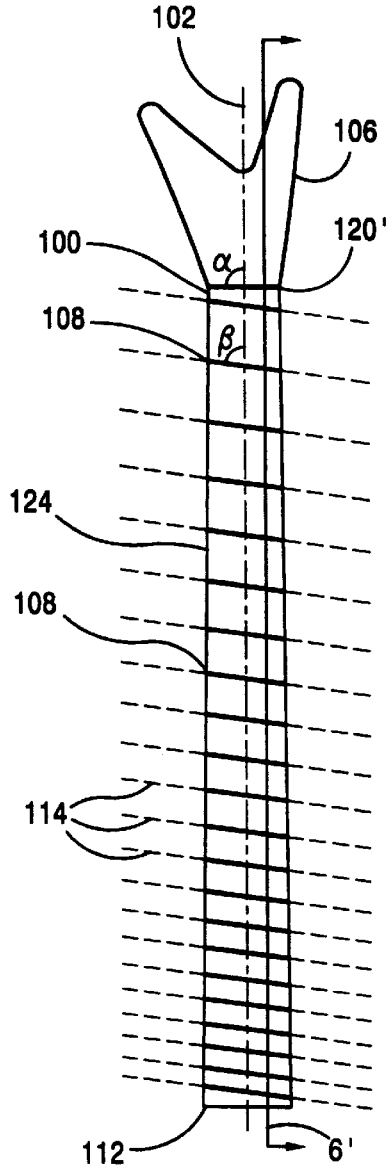
FIG. 2 is a top plan view of the neck of a string instrument of the present invention.
Figure 3:
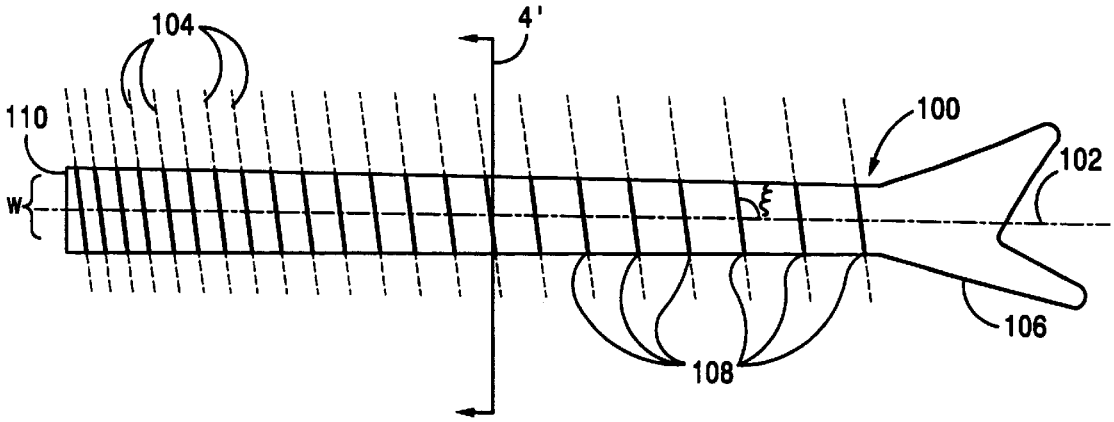
FIG. 3 is a top plan view of a variant of the neck of FIG. 2.
Figure 5:
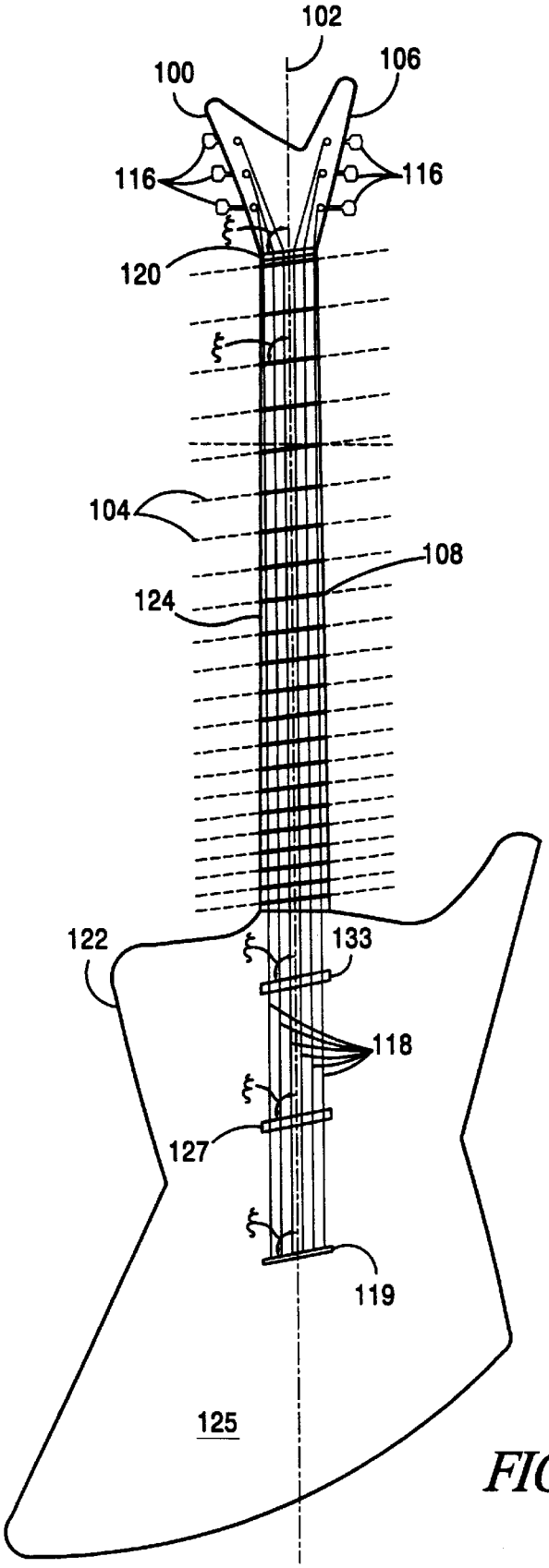
FIG. 5 illustrates a string instrument that is a guitar having the neck of FIG.3.

FIG. 5 illustrates a string instrument 122 that includes finger board 124. Finger board 124 has a plurality of frets 108 along the length of finger board 124. Finger board 124 has a finger board axis running along the length of finger board 124 along imaginary line 102 (FIGS. 2, 3, and 5). Frets 108 are arranged substantially or totally parallel one to another. Frets 108 have substantially or totally parallel fret axes arranged along imaginary lines 104 (FIGS. 2 and 5), 114 (FIG. 2). The fret axes along imaginary lines 104, 114 are oriented at a non-perpendicular angle $\beta$ (FIG. 2) or $\epsilon$ (FIGS. 3 and 5) with respect to finger board 124 axis imaginary line 102. Imaginary line 102 is an axis of symmetry of finger board 124 in one variant. Necks 100, 100' and 100" include optional head 106.

The non-perpendicular angle is an obtuse angle $\epsilon$ (FIGS. 3 and 5) or an acute angle $\beta$ (FIG. 2). The non-perpendicular angle is an angle in the range of 89 degrees to about 85 degrees, an angle in the range of about 85 degrees to about 75 degrees, an angle in the range of about 75 degrees to about 45 degrees, an angle in the range of about 45 degrees to about 10 degrees. The non-perpendicular angle is an angle is in the range of about 91 degrees to about 95 degrees, in the range of about 95 degrees to about 105 degrees, and in the range of about 105 degrees to about 170 degrees.

It is appreciated that by aligning frets 108 at a non-perpendicular angle with respect to imaginary line 102 a user has a longer reach along fret board 110, 112. Also the user's fmgers can reach more frets 108 and therefore play more notes readily and rapidly. That is the span of frets 108 that a user's fingers can reach is greater, thus providing for easier and faster play. Consequently, playing chords is greatly facilitated. Further, advantages include a reduced risk of muscle and joint fatigue from play since the fingers of a user's hand rest more naturally on fret board 110, 112 during play of string instrument 122.

A variety of string instruments are known that can utilize the present invention. Exemplary string instruments include a guitar, an acoustic guitar, a harp, a zither, an electric guitar, a bass guitar, a mandolin, a sitar, a ukulele, and a banjo. The use of the invention is of course contemplated in other string instruments that are manually played with a user's fingers.

It is further appreciated that as shown in FIG. 5, saddle 119, nut 120, pick-up(s) 133, and/or bridge nut 127 can be oriented on string instrument body 125 in such a way that the saddle 119, nut 120, pick-up(s) 133, and/or bridge nut 127 are angled to be substantially parallel to frets 108. In another embodiment (not shown) saddle 119, nut 120, pick-up(s) 133, and/or bridge nut 127"" can be oriented perpendicular to axis 102. It is also appreciated that the axis of the finger board 102 can either be in the plane of string instrument body 125, angled back of the plane of string instrument body, or angled forward of the plane of the string instrument body 125 in variants of the invention.

The invention also includes a method of manufacturing a string instrument 122 having a finger board 124, having a plurality of substantially parallel frets 108, and having a finger board 124 axis along the length of finger board 124. The method includes the steps of attaching, fixing, removeably connecting, or mounting the plurality of substantially parallel frets 108 on finger board 124 along the length of finger board 124 at a non-perpendicular angle with respect to finger board 124 axis that runs along imaginary line 102. Conventional frets 108 are utilized in the invention. Finger board 124 can also be made from a variety of materials. The method also includes the steps of forming and assembling string instrument 122.

Figure 9:
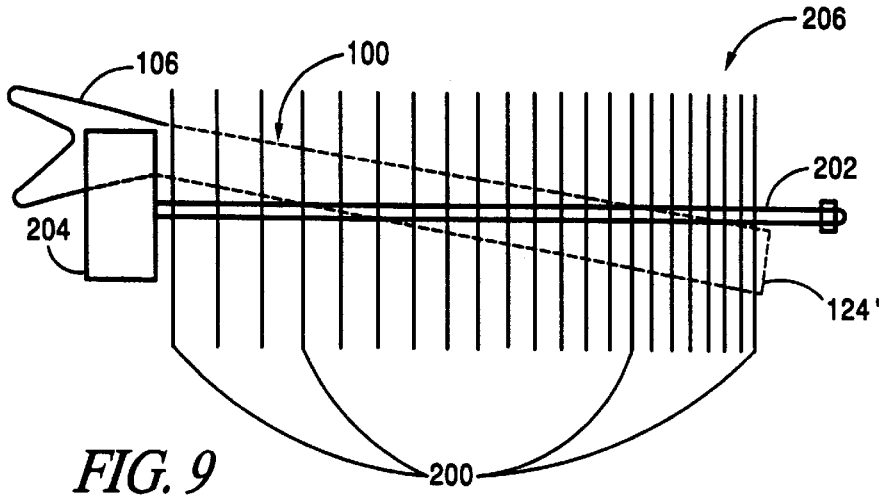
FIG. 9 illustrates a top plan view of an apparatus for manufacturing the finger board of the string instrument of FIG. 5.

Apparatus 206 is utilized for manufacturing string instrument 122. The string instrument 122 has finger board 124, a plurality of substantially parallel frets 108, and a finger board 124 axis along the length of finger board 124. The apparatus 206 includes cutter 206 for cutting cuts or notches 109 which are cut along imaginary lines 104, 114 in fret board 124. As shown in FIG. 9, cutter 206 includes a plurality of blades 200 (rotary or band) that notch or cut base fret board 124' to form cuts or notches 109 which are substantially congruent to fret 108 bottom portions.

Cutter 206 includes shaft 202 onto which blades 200 are mounted. Shaft 202 is driven by motor 204. It is appreciated that base, uncut fret board 124' is fed into cutter 206 at an appropriate pre-determined angle to form the appropriate cuts or notches 108. It is also appreciated that while a rotary system is shown in FIG. 9 it is also possible to use a band saw(s) with a plurality of blades, a sabre saw with a plurality of blades, a laser, or other cutting instrument to make appropriate cuts 109 in base fret board 124'. It is also appreciated that frets 108 may be directly mounted on top of fret board 124 with adhesive without cutting cuts 109.

Figure 11:
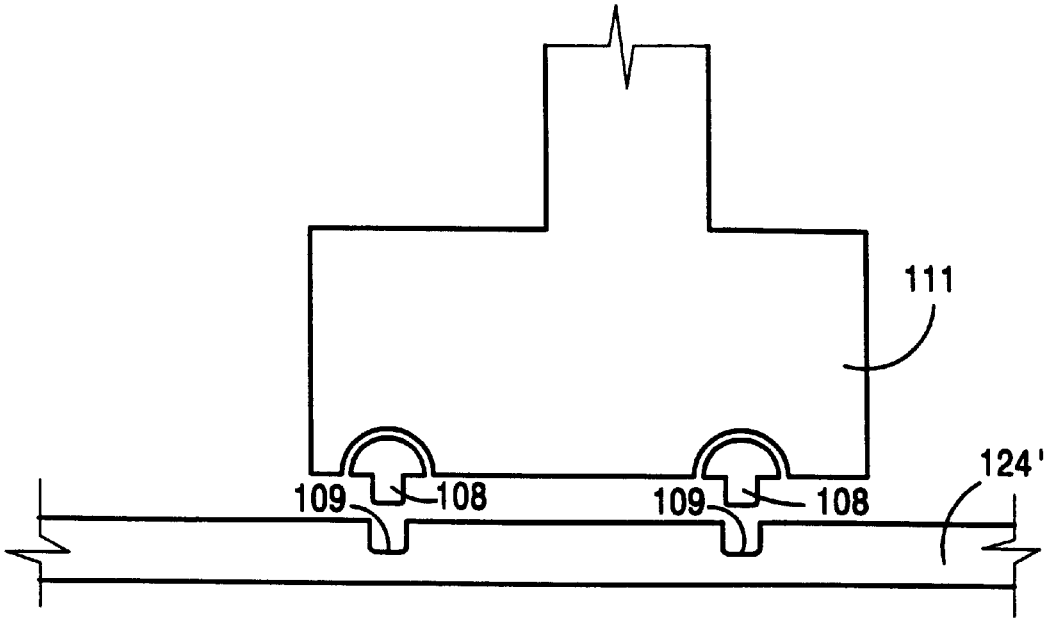
FIG. 11 illustrates an apparatus for inserting frets into a base finger board according to the present invention; and, FIG. 12 is a variant of the invention that provides for frets at varying angles on a fret board.

Frets 108 are inserted into cuts 109 and affixed thereto with adhesive, friction fit or other appropriate means. An optional fret insertion head(s) 111 (FIG. 11) attach a single or the plurality of substantially parallel frets 108 in cuts 109 in base finger board 124' along the length of finger board 124' at a non-perpendicular angle $\beta$ or $\epsilon$ with respect to finger board 124 axis along imaginary lines 104, 114. It is appreciated that other mechanical assemblies can be used to affix frets 108 to fret cuts 109 in finger board 124. A string instrument former and assembler is then used to assemble the members of the string instrument. It is appreciated that frets 109 may be also formed integrally with base fret board 124' and need not be separate therefrom.

Figure 10:
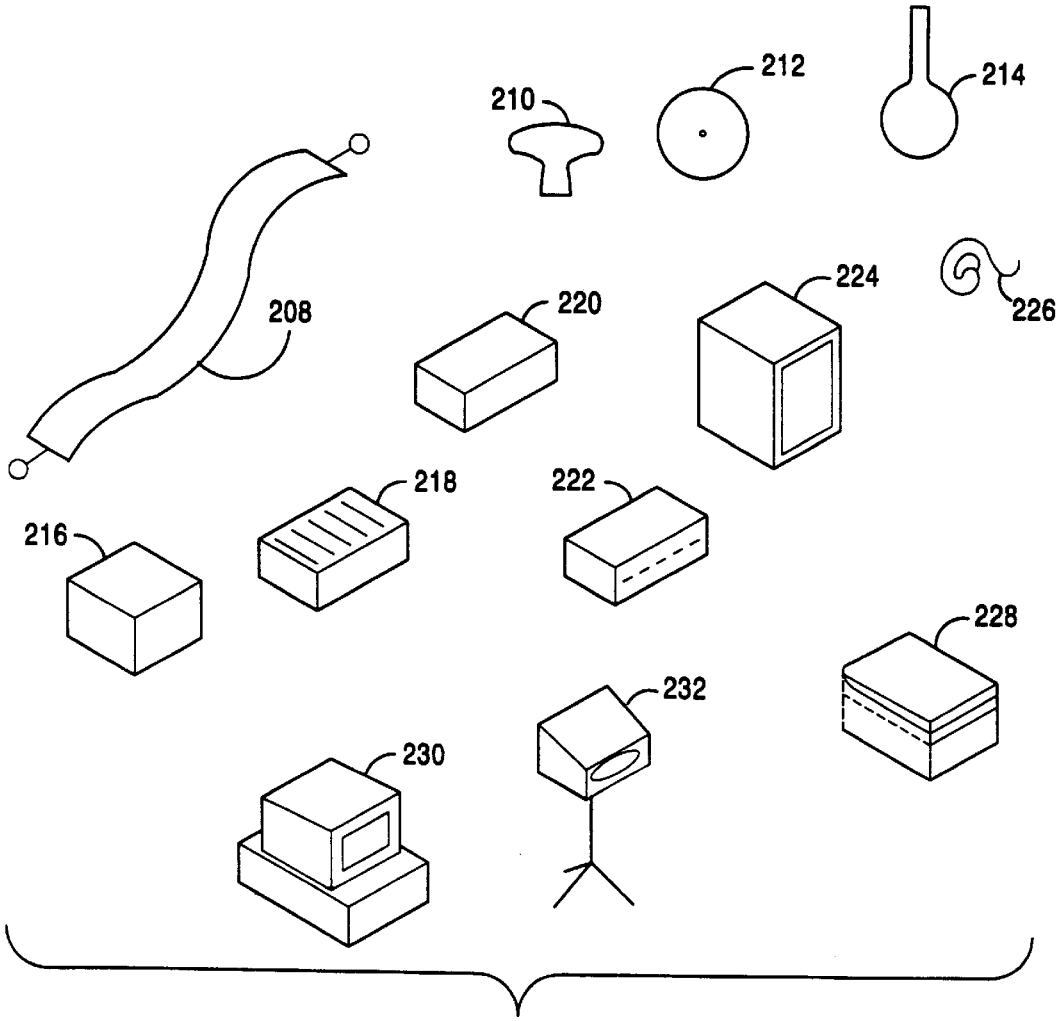
FIG. 10 illustrates the various accessories of a kit of the present invention.

A kit for playing music is also described herein. The kit includes string instrument 122 or other variant thereof as described herein. The kit also includes a string instrument accessory. Exemplary string instrument accessories are illustrated in FIG. 10. The string instrument 122 includes a finger board 124 having a plurality of frets 108 and having a finger board 124 axis along the length of the finger board 124, the frets 108 having substantially parallel fret axes, and the fret axes oriented at a non-perpendicular angle with respect to the finger board 124 axis.

The string instrument accessory as shown in FIG. 10 is selected from the group consisting of a string instrument strap 208, tuning knobs 210, 116, set of strings 118, roll of string 212, a string instrument carrying case 214, a synthesizer 216, a mixer 218, an amplifier 222, speakers 224, guitar cable 226, foot pedals 228, a computer having a microprocessor 230 and routines for playing instrument 212, a lighting system related to the string instrument 220, and a loudspeaker 232.

Figure 4:
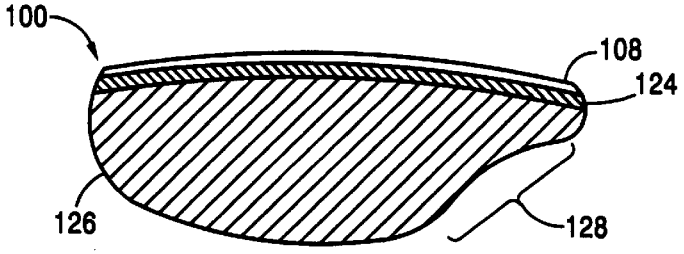
FIG. 4 illustrates a cross sectional view of the neck of FIG. 3 along section 4' and further including a curved portion of a neck body.

FIG. 4 illustrates a cross-section of a variant of the neck 100 for a string instrument of the present invention including an optional neck body 126. The neck 100 includes finger board 124 having a plurality of frets 108. Neck 100 includes neck body 126 which is generally formed of conventional materials including wood, metal, plastic, carbon fibre, teflon, fiberglass and the like. Neck body 126 is connected to string instrument body 125. Neck body 126 is also connected to finger board 124. Neck body 126 has neck body contoured portion 128' along the length of neck body. Neck body contoured portion 128' is sized and dimensioned to accommodate a user's thumb joint, muscles, or bone of a user on a hand of a user that grasps neck body 126 during play of the string instrument. It is appreciated that wear on the neck body during repeated play by a user is reduced. Contoured portion 128' can be sized and dimensioned to accommodate the most common average size of a user's hand, e.g. a child, an adult male, or adult female. Contoured portion 128' can also be universally sized and dimensioned. Contoured portion 128' can also custom made to provide for a custom fit to a user's hand, palm and fingers.

It is appreciated that the use of contoured portion 128' will not detrimentally affect the warping of neck 100. The strings 118 that rest over contoured portion 128' are generally under less tension than the other strings 118 that are not over contoured portion 128'. As such there is less of a tendency to warp of neck 100. The use of contoured portion 128' results in less wear and pressure on the joint that joins the proximal phalanx and distal phalanx, releases the tension on the joint associated with the thumb and hand, and helps reduce the risk of carpal tunnel syndrome and nerve injury.

Figure 6:
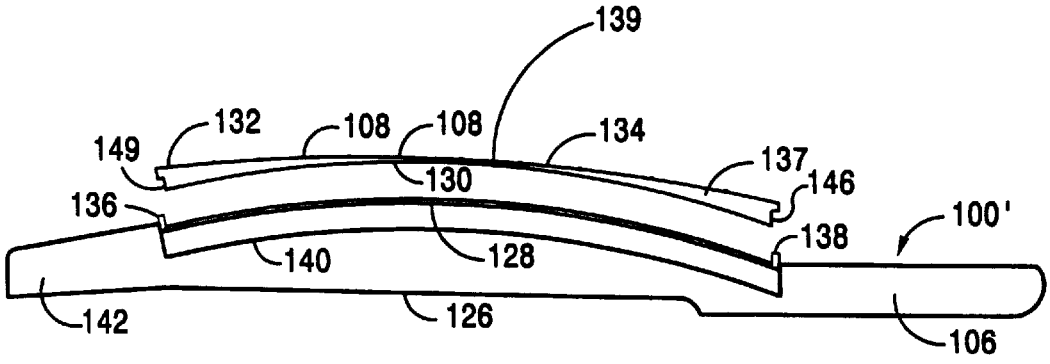
FIG. 6 illustrates an exploded side view of the neck of FIG. 7.
Figure 7:
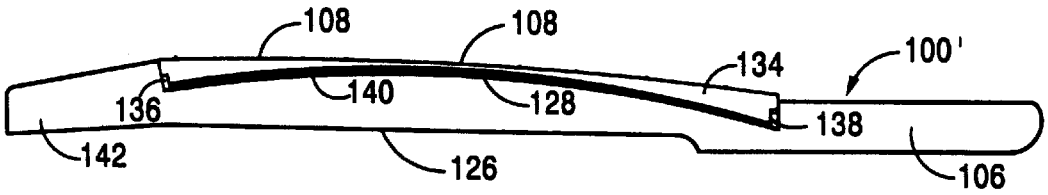
FIG. 7 illustrates an assembled side view of the neck of FIG. 6.
Figure 8:
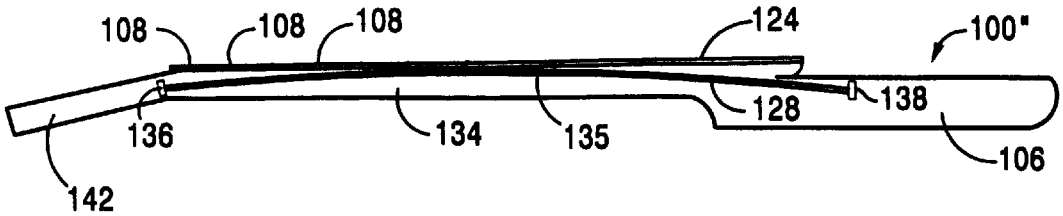
FIG. 8 illustrates a variant of the neck of FIG. 7.

FIGS. 6–8 illustrate necks 100', 100" for a string instrument 122. FIG. 6 is an exploded view of the assembled neck of FIG. 7. Neck 100' includes finger board 124 having a plurality of frets 108 and neck body 126. Neck body 126 is connected to string instrument body 125 at connecting portion 142. Neck body 126 has a curved or bowed up portion 140. Portion 140 is made by cutting neck body 126 or forming it otherwise. Reinforcing member 128 is curved downwardly toward or with respect to the bottom of neck body 126. Reinforcing member 128 is made from a spring steel, a metal, carbon steel, a hardwood, fibreglass, Kevlar® or other appropriate material. Reinforcing member 128 functions in much the same way as elements of a bridge (highway bridge, train bridge, pedestrian bridge) using the principles of bridge construction. Reinforcing member 128 is arched so that when strings 118 are tensioned, reinforcing member 128 pushes against stops 136, 138 which are constructed from wood, metal or other appropriate material. These stops 136, 138 can optionally be located in notches 144, 146 or some other location as appropriate.

This results in a decrease in warping of the entire neck 100', 100". That is, a warping force is generated by the tensioned strings 118 that is counteracted by the support of the entire assembly shown. Fret board member 134 can be of one or two piece construction. Member 128 is shown as a single piece in FIGS. 6 and 7. It is contemplated that fret board member 128 can be of a two piece construction where fret board 124 is connected to member 128 by adhesive or other means known in the art. Reinforcing member 128 generally extends across the full width w of neck body 100, 100' and can be tapered as appropriate to be substantially congruent to neck body 100 or fret board 124. In a variant member 128 can rest in a pocket (not shown) within the neck body as appropriate. Member 128 can optional be of spring steel and biased down toward neck body 126.

Fret board member 134 is also curved or arched at the bottom end 130 facing member 128. End portions 132 and 137 are generally thicker in height than middle portion 139 in one variant of the invention.

FIG. 8 illustrates a variant of the invention in which a single or plurality of members 128 can rest in neck body 126 in neck variant 100" substantially parallel to one another. Neck body 134 includes a single or a plurality of grooves 135 that are cut into neck body 134. Grooves 135 can be cut into each side of neck body 134 across the length of the neck body 134. A single or a plurality of members 128 are then fitted into these grooves 135, along with optional stops 136, 138. An optional lip 137 is provided to accommodate the reinforcing member assembly. Fret board 124 in then connected to neck body 134 as required. In this variant, reinforcing member 128 extends partially across width w of neck body 134 or neck 100".

Figure 12:
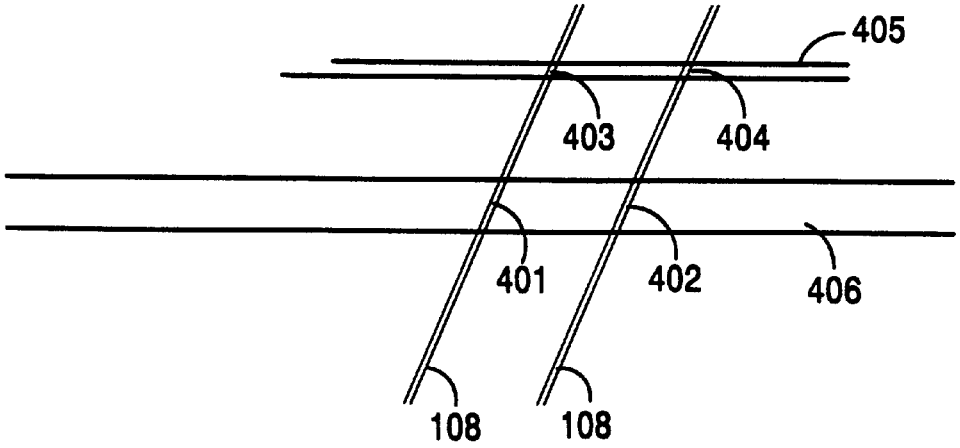

In FIG. 12, a variant of the invention provides for adjustable frets on a requisite fret board 124 or neck 100. Normally, fretted instrument 122 has frets 108 thereon fixedly secured to fret board 124. In the variant of FIG. 12, a plurality of frets 108 are simultaneously adjustable to different angles $\epsilon$ or $\beta$. Frets 108 are connected to a center member 406 (member 406 is generally fixedly secured to neck 100) or fret board 124 at pivot points 401, 402. Connecting member 405 is connected to frets 108 at pivot points 403, 404. When members 405 or 406 are moved all frets 108 move in unison to a predetermined angle. The member 405, 406 or frets 108 are then locked in place by locking means (not shown) and the instrument can be played. It is appreciated that the assembly shown in FIG. 12 is only illustrative and other means can also be used to obtain a plurality of simultaneously, variably adjustable frets 108 so that fretted string instrument 122 of the present invention can be customized to a user's preference.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A neck, a bridge string instrument, comprising:

a finger board having a nut and a plurality of frets and having a fingerboard axis along the length of said finger board, said frets having substantially parallel fret axes, and said fret axes and said nut oriented at a non-perpendicular anile with resect to said finger board axis, a neck body connected to said finger board, said neck body having a reinforcing member curved downwardly with respect to the bottom of said neck body, and said bridge being oriented at an angle that is greater than said non-perpendicular angle;

whereby warping of said neck body is greatly reduced and ease of play of said string instrument is facilitated.

2. The neck of claim 1 connected to a string instrument.

3. The neck of claim 1 in which said reinforcing member extends across a full width of said neck body.

4. The neck of claim 1 in which said reinforcing member extends partially across the width of said neck body.

5. The neck of claim 1 in which said nut is substantially parallel to said fret axes.

6. The string instrument of claim 1 in which said non-perpendicular angle is an acute angle.

7. The string instrument of claim 1 in which said non-perpendicular angle is an obtuse angle.

8. The string instrument of claim 1 in which said non-perpendicular angle is in the range of 89 degrees to about 85 degrees.

9. The string instrument of claim 1 in which said non-perpendicular angle is in the range of about 85 degrees to about 75 degrees.

10. The string instrument of claim 1 in which said non-perpendicular angle is in the range of about 75 degrees to about 65 degrees.

11. The string instrument of claim 1 in which said non-perpendicular angle is in the range of about 65 degrees to about 45 degrees.

12. The string instrument of claim 1 in which said non-perpendicular angle is in the range of about 45 degrees to about 10 degrees.

13. The string instrument of claim 1 in which said non-perpendicular angle is in the range of 91 degrees to about 95 degrees.

14. The string instrument of claim 1 in which said non-perpendicular angle is in the range of 95 degrees to about 105 degrees.

15. The string instrument of claim 1 in which said non-perpendicular angle is in the range of 105 degrees to about 170 degrees.

16. The neck of claim 1 further comprising a string instrument component, said string instrument component selected from the group consisting of a guitar body, a harp body, a zither body, an electric guitar body, a bass guitar body, a mandolin body, a sitar body, a ukulele body, a banjo body, a balalaika body, a dulcimer body, a lute body, and a virginal body.

* * * * *